US008173958B2

(12) United States Patent
Nakano

(10) Patent No.: US 8,173,958 B2
(45) Date of Patent: May 8, 2012

(54) MASS SPECTROMETER

(75) Inventor: Tomohito Nakano, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 197 days.

(21) Appl. No.: 12/742,317

(22) PCT Filed: Nov. 22, 2007

(86) PCT No.: PCT/JP2007/001291

§ 371 (c)(1),
(2), (4) Date: May 11, 2010

(87) PCT Pub. No.: WO2009/066358

PCT Pub. Date: May 28, 2009

(65) Prior Publication Data

US 2010/0264307 A1 Oct. 21, 2010

(51) Int. Cl.
*H01J 49/04* (2006.01)
*H01J 49/00* (2006.01)

(52) U.S. Cl. ..... 250/282; 250/289; 250/425

(58) Field of Classification Search ..... 250/281, 250/282, 288, 289, 423 R, 425, 429
See application file for complete search history.

(56) References Cited

U.S. PATENT DOCUMENTS

| | | | | |
|---|---|---|---|---|
| 7,232,992 | B2 * | 6/2007 | Whitehouse et al. | 250/288 |
| 7,586,091 | B2 * | 9/2009 | Takahashi et al. | 250/288 |
| 7,619,216 | B1 * | 11/2009 | Whitehouse et al. | 250/288 |
| 7,872,225 | B2 * | 1/2011 | Whitehouse et al. | 250/288 |
| 2001/0042413 | A1 * | 11/2001 | Sakairi et al. | 73/863.11 |
| 2003/0168586 | A1 * | 9/2003 | Yamaguchi et al. | 250/281 |
| 2005/0258360 | A1 * | 11/2005 | Whitehouse et al. | 250/288 |
| 2006/0118715 | A1 * | 6/2006 | Schneider et al. | 250/290 |
| 2006/0214101 | A1 * | 9/2006 | Takahashi et al. | 250/288 |

FOREIGN PATENT DOCUMENTS

| | | | |
|---|---|---|---|
| JP | 01-289029 | A | 11/1989 |
| JP | 05-109356 | A | 4/1993 |
| JP | 5-044849 | U | 6/1993 |
| JP | 11-118764 | A | 4/1999 |
| JP | 2001-343361 | A | 12/2001 |
| JP | 2003-202325 | A | 7/2003 |
| JP | 2003-222612 | A | 8/2003 |
| JP | 2005-024340 | A | 1/2005 |

* cited by examiner

*Primary Examiner* — Bernard E Souw
(74) *Attorney, Agent, or Firm* — Sughrue Mion, PLLC

(57) ABSTRACT

In a conventional mass spectrometer in which a pipe to be electrically heated is provided between a separation wall separating an ionization chamber for ionizing a sample and a separation wall separating an analysis chamber, and an ion in the ionization chamber is introduced through the pipe to the analysis chamber, the pipe is attached or detached by screwing or unscrewing a connector portion of an electrode connected to the pipe and a connector portion of a support disposed at the separation wall. However, with this structure, the screw needs to be loosened until it is completely unscrewed every time it is washed or exchanged, and thus the operability is deteriorated. According to the present invention, a screw hole for screwing the electrode connector portion is in the form of a cut-out portion facing in the direction of rotation centering on an axis of the pipe. Accordingly, the pipe can be attached or detached by only loosening the screw without completely unscrewing it.

6 Claims, 3 Drawing Sheets

MASS SPECTROMETER

TECHNICAL FIELD

The present invention relates to a mass spectrometer for ionizing and mass analyzing a liquid sample in an ionization chamber, and in particular to an interface used in a liquid chromatograph mass spectrometer to introduce a sample from a liquid chromatograph into a measurement unit.

BACKGROUND ART

In a liquid chromatograph mass spectrometer, a liquid chromatograph is connected to a mass spectrometer through an interface (for example, refer to Patent Document 1). FIG. 5 shows a schematic configuration of a common liquid chromatograph mass spectrometer. The interface consists of an ionization probe 2 and a sample introduction unit 3. The mass spectrometer consists of a vacuum chamber B and a mass analyzer 4. A sample introduced from a liquid chromatograph 1 is sprayed from the ionization probe 2 and ionized inside an ionization chamber A under atmospheric pressure. The ionized sample is introduced to the mass spectrometer through the sample introduction unit 3 connecting a first separation wall 13 and a second separation wall 14 disposed between the ionization chamber A under atmospheric pressure and the vacuum chamber B. The spray direction of the ionization prove 2 and the direction of introducing the sample to the sample introduction unit 3 are arranged to be perpendicular to each other. The sample introduction unit 3 is heated to remove noise components or solvent components.

The following description will discuss a configuration of the conventional sample introduction unit 3 with reference to FIG. 4. FIG. 4(*b*) is a cross-sectional view illustrating a structure of the sample introduction unit, and FIG. 4(*a*) is a left side view of FIG. 4(*b*). As shown in those figures, the sample introduction unit 3 consists of a pipe 5, a first electrode (holding member) 6, a second electrode (holding member) 7, a resin collar 8, a temperature detector 9, a ferrule 10, a push screw 11, a plate 12, a first setscrew 17, a second setscrew 18, a first support 15, and a second support 16.

The first electrode 6, the second electrode 7, the ferrule 10, the push screw 11, the first support 15, and the second support 16 among the previously listed members are all made of conductive materials, such as stainless steel.

In the sample introduction unit 3, the pipe 5, and the first electrode 6 and the second electrode 7 which are connected to the pipe 5 are collectively called a pipe section. The pipe section is detachably attached to the mass spectrometer, details of which will be explained later.

The pipe 5 is made of a conductive material such as stainless steel, and the ionized sample is introduced from the ionization chamber A to the vacuum chamber B through the pipe 5.

The pipe 5 and the first electrode 6 are fixed to each other with the plate 12 at a vicinity of the front end of the pipe 5 (on the side of the ionization chamber A). The pipe 5 and the second electrode 7 are fixed to each other with the ferrule 10 and the push screw 11 at a vicinity of the back end of the pipe 5 (on the side of the vacuum chamber B). The first electrode 6 is insulated from the second electrode 7 with the resin collar 8 interposed therebetween.

The first electrode 6 has an integrally-formed first electrode connector portion 6*a* which is perforated with a first fixation hole F. The first electrode connector portion 6*a* is connected, with the first setscrew 17, to a tip, specifically a first support connector portion 15*a*, of the first support 15 extending in parallel with the pipe 5 from the second separation wall 14.

The second electrode 7 has an integrally-formed second electrode connector portion 7*a* which is perforated with a second fixation hole G. The second electrode connector portion 7*a* is connected, with the second setscrew 18, to a tip, specifically a second support connector portion 16*a*, of the second support 16 extending in parallel with the pipe 5 from the second separation wall 14.

In this manner, the sample introduction unit 3 is connected to the first support 15 and to the second support 16 using the first setscrew 17 and the second setscrew 18, respectively. Accordingly, the sample introduction unit 3 is installed to the second separation wall 14.

The first support 15 and the second support 16 are both formed of a conductive material, such as stainless steel. The first support 15 is coupled to a first power cable crimp terminal 19 extending from a power source (not shown in the figures), and the second support 16 is coupled to a second power cable crimp terminal 20 extending from the same power source.

When a voltage is applied from the power source to the first power cable crimp terminal 19 and the second power cable crimp terminal 20, an electric current is supplied to the pipe 5 through the first electrode 6 and the second electrode 7 to heat the pipe 5. The temperature detector 9, including a platinum sensor and other devices, is mounted on the pipe 5. Based on the temperature detected by the temperature detector 9, the temperature of the pipe 5 can be appropriately controlled.

Electric insulation is maintained with a resin material member (not shown) between the first electrode 6 and the first separation wall 13, between the second electrode 7 and the second separation wall 14, between the first support 15 and the second separation wall 14, and between the second support 16 and the second separation wall 14.

[Patent Document 1] Japanese Unexamined Patent Application Publication No. 2003-202325

DISCLOSURE OF THE INVENTION

Problems to be Solved by the Invention

As described earlier, in a conventional liquid chromatograph mass spectrometer, the pipe 5 of the sample introduction unit 3 can be attached or detached by tightening or removing the two screws, the first setscrew 17 and the second setscrew 18. However, in order to detach the pipe 5, both the first setscrew 17 and the second setscrew 18 need to be completely unscrewed, problematically deteriorating the operability. Furthermore, the screws may accidentally fall in the apparatus.

Means for Solving the Problems

A mass spectrometer according to the present invention which has been made to solve the foregoing problems is a mass spectrometer in which a pipe to be electrically heated is provided between a separation wall separating an ionization chamber for ionizing a sample and a separation wall separating an analysis chamber, and an ion in the ionization chamber is introduced through the pipe to the analysis chamber, having a pipe section including the pipe and a holding member connected to the pipe for connecting the pipe to the mass spectrometer, wherein the pipe section is detachably attached to the mass spectrometer by screwing the holding member to the mass spectrometer through a cut-out portion formed in the holding member.

Another mass spectrometer according to the present invention is a mass spectrometer in which a pipe to be electrically heated is provided between a separation wall separating an ionization chamber for ionizing a sample and a separation wall separating an analysis chamber, and an ion in the ionization chamber is introduced through the pipe to the analysis chamber, having a conductive first support disposed at either of the separation walls and partly connected to a power source, and a conductive second support disposed at either of the separation walls and partly connected to the power source, wherein a pipe section including the pipe, and a first electrode and a second electrode for supplying an electric current to the pipe, the first electrode and the second electrode being respectively connected to both ends of the pipe, is detachably attached to the mass spectrometer by screwing a first electrode connector portion of the first electrode to a first support connector portion provided on the first support and screwing a second electrode connector portion of the second electrode to a second support connector portion provided on the second support rod, and a screw hole for screwing the first electrode connector portion and a screw hole for screwing the second electrode connector portion are each in the form of a cut-out portion facing in the direction of rotation centering on an axis of the pipe.

Moreover, in the mass spectrometer according to the present invention, a protrusion for determining a limit position of the rotation centering on an axis of the pipe in the pipe section is provided on at least one of either the first electrode connector portion or the second electrode connector portion, or on at least one of either the first support or the second support.

Effect of the Invention

In the mass spectrometer according to the present invention, the pipe is attached to or detached from the mass spectrometer by screwing the holding member connected to the pipe through the cut-out portion formed in the holding member. Therefore, the screw does not need to be completely unscrewed; the pipe section can be detached by rotating the pipe section while the screw is properly loosened. Since the pipe section can be attached by the reverse operation, unscrewing of the screw is not necessary. Therefore, efficiency of attaching or detaching the pipe is improved.

EXPLANATION OF NUMERALS

1 . . . Liquid Chromatograph
2 . . . Ionization Probe
3 . . . Sample Introduction Unit
4 . . . Mass Analyzer
5 . . . Pipe
6 . . . First Electrode
6*a* . . . First Electrode Connector Portion
6*b* . . . First Cut-Out Portion
6*c* . . . Protrusion
7 . . . Second Electrode
7*a* . . . Second Electrode Connector Portion
7*b* . . . Second Cut-Out Portion
8 . . . Resin Collar
9 . . . Temperature Detector
10 . . . Ferrule
11 . . . Push Screw
12 . . . Plate
13 . . . First Separation Wall
14 . . . Second Separation Wall
15 . . . First Support
15*a* . . . First Support Connector Portion
16 . . . Second Support
16*a* . . . Second Support Connector Portion
17 . . . First Setscrew
18 . . . Second Setscrew
19 . . . First Power Cable Crimp Terminal
20 . . . Second Power Cable Crimp Terminal
A . . . Ionization Chamber
B . . . Vacuum Chamber
F . . . First Fixation Hole
G . . . Second Fixation Hole

BEST MODE FOR CARRYING OUT THE INVENTION

Figure 1:
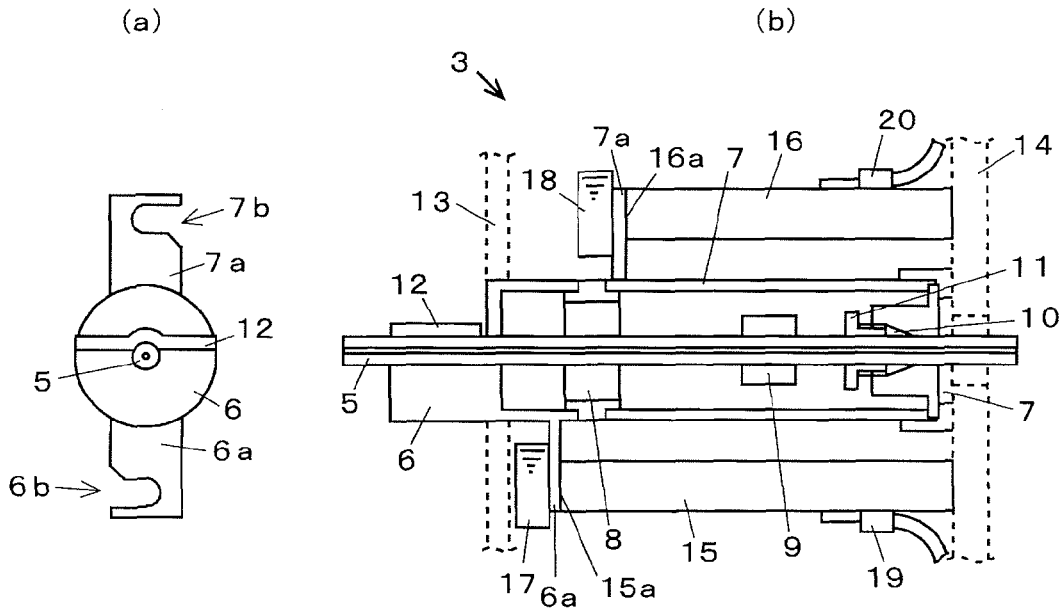
FIG. 1(*a*) is a left side view and FIG. 1(*b*) is a cross-sectional view which both illustrate a structure of the sample introduction unit in the mass spectrometer according to the embodiment of the present invention.

The following description will discuss the embodiments of the mass spectrometer according to the present invention with reference to the figures. FIG. 1 is a view illustrating a structure of the sample introduction unit in the mass spectrometer according to the present invention. FIG. 1(*b*) is a cross-sectional view of the sample introduction unit, and FIG. 1(*a*) is a left sideview of the sample introduction unit.

Figure 4:
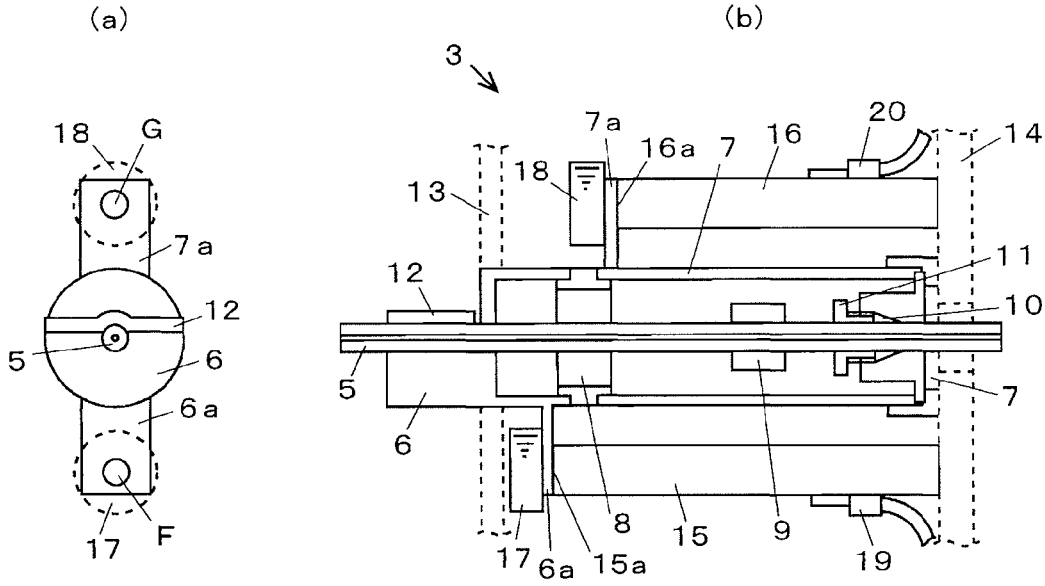
FIG. 4(*a*) is a left side view and FIG. 4(*b*) is a cross-sectional view which both illustrate a structure of the sample introduction unit in a conventional mass spectrometer.
Figure 5:
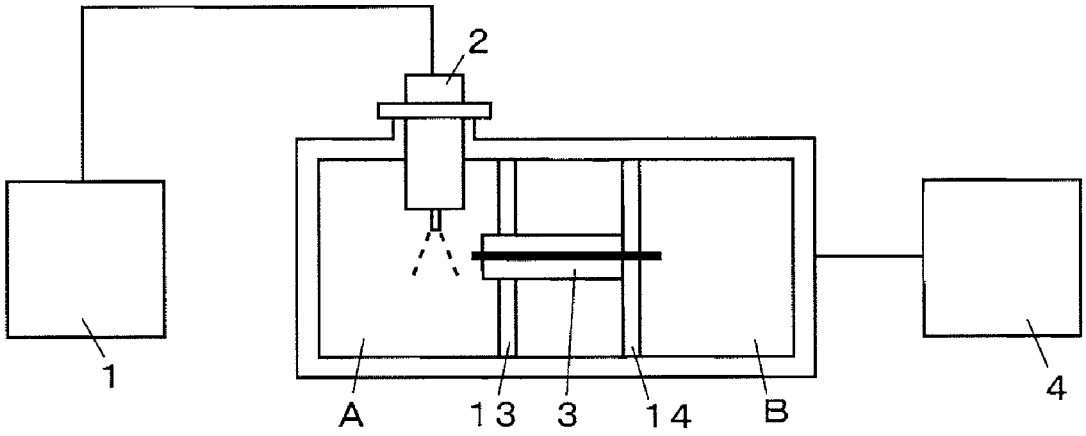
FIG. 5 is a schematic view which illustrates an outline structure of a conventional liquid chromatograph mass spectrometer.

The mass spectrometer according to the present embodiment has basically the same structure as that of the prior art mass spectrometer described with reference to FIGS. 4 and 5. Therefore, in FIG. 1, the same structural components as those shown in FIG. 4 are indicated with the same numerals, and therefore the detailed explanations are omitted.

The mass spectrometer according to the present embodiment has, as its characteristics, a structure in which, in a pipe section including a pipe 5, a first electrode 6, and a second electrode 7, a screw hole for screwing a first electrode connector portion 6*a* of the first electrode 6 is in the form of a cut-out portion (first cut-out portion 6*b*) facing in the direction of rotation centering on an axis of the pipe 5 as shown in FIG. 1(*a*). Similarly, a screw hole for screwing a second electrode connector portion 7*a* of the second electrode 7 corresponds to a cut-out portion (second cut-out portion 7*b*) facing in the direction of rotation centering on the axis of the pipe 5.

With this structure, a first setscrew 17 and a second setscrew 18 do not need to be completely unscrewed from the first electrode connector portion 6*a* and the second electrode connector portion 7*a*, respectively, for attachment or detachment of the pipe section.

In order to attach the pipe section to the mass spectrometer, the pipe section is inserted from the side of an ionization chamber A to the side of a vacuum chamber B and is then rotated clockwise centering on the pipe 5 as an axis. Thereby, the shaft of the first setscrew 17 and the shaft of the second setscrew 18 are engaged with the first cut-out portion 6*b* and the second cut-out portion 7*b*, respectively. Next, the first setscrew 17 and the second setscrew 18 are tightened so that the first electrode connector portion 6*a* and the second electrode connector portion 7*a* are fixed to a first support 15 and a second support 16. Accordingly, the pipe section is fixed to the mass spectrometer.

The pipe section can be detached from the mass spectrometer by reversing the foregoing procedure. Namely, the pipe section can be detached from the mass spectrometer by appropriately loosening the first setscrew 17 and the second setscrew 18, rotating the pipe section counterclockwise, and pulling it to the side of the ionization chamber A.

It is to be noted that the first cut-out portion and the second cut-out portion may be formed to be slightly larger than the shaft of the first setscrew 17 and the shaft of the second setscrew 18.

Figure 2:
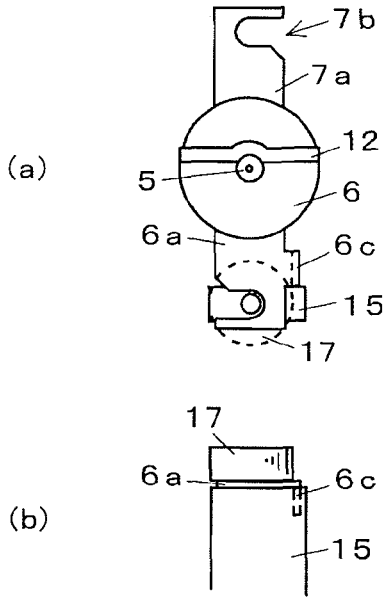
FIG. 2(*a*) is a left side view of the sample introduction unit in the mass spectrometer according to another embodiment of the present invention, and FIG. 2(*b*) is a lower side view of a part of FIG. 2(*a*).
Figure 3:
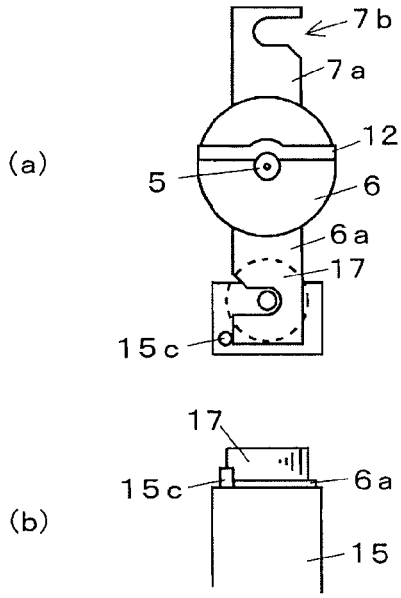
FIG. 3(*a*) is a left side view of the sample introduction unit in the mass spectrometer according to still another embodiment of the present invention, and FIG. 3(*b*) is a lower side view of a part of FIG. 3(*a*).

The following description will discuss another embodiment of the mass spectrometer according to the present invention with reference to FIGS. 2 and 3.

FIG. 2(*a*) is a left side view of the sample introduction unit in the mass spectrometer according to the present embodiment, and FIG. 2(*b*) is a lower side view of a part of the sample introduction unit. In the mass spectrometer according to the present embodiment, a protrusion 6*c* extending in the direction of the axis of the pipe 5 is provided on a part of the first electrode connector portion 6*a*. Therefore, when the pipe section is inserted from the side of the ionization chamber A to the side of the vacuum chamber B to attach the pipe section to the mass spectrometer, a clockwise rotation of the pipe section centering on the pipe 5 as an axis allows the protrusion 6*c* to contact the first support 15, blocking further rotation of the pipe section. With this structure, the position to fix the pipe section to the mass spectrometer can be surely determined. Further, this mechanism also prevents the pipe section from warping in the case where the first electrode does not have much strength. In other words, the pipe section does not need to have a high rigidity. Therefore, employment of the structure of the present embodiment makes it possible to reduce the cost of the mass spectrometer.

The protrusion to determine the rotation limit position of the pipe section may be provided only on the first electrode connector portion 6*a* as in the foregoing embodiment, or may be provided only on the second electrode connector portion 7*a*, or may be provided on both the first electrode connector portion 6*a* and the second electrode connector portion 7*a*. Further, the protrusion may be provided on a part of the first support as shown in FIG. 3. It is of course possible to provide the protrusion on the second support or on both the first support and the second support.

It should be noted that the foregoing descriptions on the mass spectrometer according to the present invention show mere examples, and therefore any further modification, adjustment, or addition may be made within the spirit of the present invention. For example, in the above embodiments, both the first support 15 and the second support 16 are disposed at the second separation wall 14; however, either or both of the first support 15 and the second support 16 may be disposed at the first separation wall 13.

Moreover, the mass spectrometer according to the present invention is not necessarily limited to a liquid chromatograph mass spectrometer, and may be any mass spectrometer in which a pipe section needs to be attached or detached.

The invention claimed is:

1. A mass spectrometer in which a pipe to be electrically heated is provided between a separation wall separating an ionization chamber for ionizing a sample and a separation wall separating an analysis chamber, and an ion in the ionization chamber is introduced through the pipe to the analysis chamber, comprising a pipe section including the pipe and a holding member connected to the pipe for attaching the pipe to the mass spectrometer, wherein the pipe section is detachably attached to the mass spectrometer by screwing the holding member to the mass spectrometer through a cut-out portion formed in the holding member.

2. A mass spectrometer in which a pipe to be electrically heated is provided between a separation wall separating an ionization chamber for ionizing a sample and a separation wall separating an analysis chamber, and an ion in the ionization chamber is introduced through the pipe to the analysis chamber, comprising a conductive first support disposed at either of the separation walls and partly connected to a power source, and a conductive second support disposed at either of the separation walls and partly connected to the power source, wherein a pipe section comprising the pipe, and a first electrode and a second electrode for supplying an electric current to the pipe, the first electrode and the second electrode being respectively connected to both ends of the pipe, is detachably attached to the mass spectrometer by screwing a first electrode connector portion of the first electrode to a first support connector portion provided on the first support and screwing a second electrode connector portion of the second electrode to a second support connector portion provided on the second support, and a screw hole for screwing the first electrode connector portion and a screw hole for screwing the second electrode connector portion are each in a form of a cut-out portion facing in a direction of rotation centering on an axis of the pipe.

3. The mass spectrometer according to claim 2, wherein a protrusion for determining a limit position of the rotation centering on an axis of the pipe in the pipe section is provided on at least one of either the first electrode connector portion or the second electrode connector portion, or on at least one of either the first support or the second support.

4. The mass spectrometer according to claim 1, wherein the mass spectrometer is a liquid chromatograph mass spectrometer.

5. The mass spectrometer according to claim 2, wherein the mass spectrometer is a liquid chromatograph mass spectrometer.

6. The mass spectrometer according to claim 3, wherein the mass spectrometer is a liquid chromatograph mass spectrometer.

* * * * *